US012576477B2

(12) United States Patent
Maughan et al.

(10) Patent No.: US 12,576,477 B2
(45) Date of Patent: Mar. 17, 2026

(54) DRESSER APPARATUS FOR DRESSING A GRINDING WHEEL

(71) Applicant: NCMT Limited, Surrey (GB)

(72) Inventors: Adrian Maughan, Surrey (GB); Ian Taylor, Surrey (GB)

(73) Assignee: NCMT LIMITED, Surrey (GB)

( * ) Notice: Subject to any disclaimer, the term of this patent is extended or adjusted under 35 U.S.C. 154(b) by 1582 days.

(21) Appl. No.: 16/498,845

(22) PCT Filed: Mar. 28, 2018

(86) PCT No.: PCT/GB2018/050851

§ 371 (c)(1),
(2) Date: Sep. 27, 2019

(87) PCT Pub. No.: WO2018/178697

PCT Pub. Date: Oct. 4, 2018

(65) Prior Publication Data

US 2020/0047311 A1 Feb. 13, 2020

(30) Foreign Application Priority Data

Mar. 31, 2017 (GB) ..... 1705265
Apr. 18, 2017 (GB) ..... 1706136

(51) Int. Cl.
*B24B 53/14* (2006.01)
*B24B 53/053* (2006.01)

(52) U.S. Cl.
CPC ..... *B24B 53/14* (2013.01); *B24B 53/053* (2013.01)

(58) Field of Classification Search
CPC ..... B24B 53/005; B24B 53/017; B24B 53/04; B24B 53/053; B24B 53/06; B24B 53/062; B24B 53/08; B24B 53/12; B24B 53/14; B24B 49/00; B24B 49/18; B24B 49/183; B28D 3/00; B28D 3/005; B28D 3/02
USPC ..... 451/56, 443; 125/2, 3, 5, 8
See application file for complete search history.

(56) References Cited

U.S. PATENT DOCUMENTS 3,000,148 A * 9/1961 Hans ..... B24B 37/08 125/11.01
4,607,607 A * 8/1986 Janutta ..... B24B 53/062 125/11.03
4,683,679 A * 8/1987 Salmon ..... B24B 45/00 451/72
5,119,599 A 6/1992 Klipper
(Continued)

FOREIGN PATENT DOCUMENTS

CN 103567834 A 2/2014
EP 1063057 A2 12/2000
(Continued)

OTHER PUBLICATIONS

Wikipedia Labyrinth Seal p. 1 (Year: 2016).*
(Continued)

*Primary Examiner* — C. A. Rivera
(74) *Attorney, Agent, or Firm* — Tarolli, Sundheim, Covell & Tummino LLP

(57) ABSTRACT

A dresser apparatus for dressing a grinding wheel, the apparatus comprising a dresser cradle unit for holding a dresser roll, and a rotary drive for driving the dresser roll, wherein the dresser cradle unit is removable from the rotary drive.

14 Claims, 8 Drawing Sheets

(56) References Cited

U.S. PATENT DOCUMENTS

| | | | | |
|---|---|---|---|---|
| 5,752,788 | A * | 5/1998 | Crum | B05B 7/1422 406/29 |
| 2007/0049182 | A1 | 3/2007 | Burgess | |
| 2012/0309271 | A1* | 12/2012 | Geiser | B24B 53/00 451/283 |
| 2013/0196572 | A1* | 8/2013 | Ko | H01L 21/67051 451/1 |
| 2019/0262917 | A1* | 8/2019 | Kordus | B24B 49/18 |
| 2022/0379432 | A1* | 12/2022 | Choi | B24B 53/017 |

FOREIGN PATENT DOCUMENTS

| | | | |
|---|---|---|---|
| FR | 2392771 | A1 | 12/1978 |
| GB | 734269 | A | 7/1955 |
| JP | H04130153 | U | 11/1992 |

OTHER PUBLICATIONS

International Search Report and Written Opinion dated Oct. 2, 2018 for corresponding International Application No. PCT/GB2018/050851.

GB Search Report dated Jun. 19, 2017 for corresponding GB Application No. 1706136.7.

* cited by examiner

DRESSER APPARATUS FOR DRESSING A GRINDING WHEEL

FIELD OF INVENTION

The present invention relates to methods and apparatus for use with grinding wheels, and more particularly to dresser rolls which may be used to dress a grinding wheel, for example in a grinding machine.

BACKGROUND

Grinding is a subset of cutting, in which each grain of abrasive functions as a microscopic single-point cutting edge (although of high negative rake angle), and shears a tiny chip that is analogous to what would conventionally be called a "cut" chip (turning, milling, drilling, tapping, etc.). The term "cutting" however is understood to refer to macroscopic cutting operations, as opposed to grinding.

Grinding can produce very fine finishes and can manufacture workpieces to very high precision. For the purposes of mass production, it can also be used to rough out large volumes of metal quite rapidly. Grinding is usually better suited to the machining of very hard materials than is conventional cutting or milling, and is of particular utility in the machining of hardened steels. Grinding wheels are used extensively in engineering for a variety of abrasive cutting and machining operations. These wheels are generally made from a composite material consisting of a coarse-particle aggregate.

For optimal use grinding wheels often need to be dressed or trued by the use of a dresser, to remove an outer layer of abrasive material and expose a fresh and sharp surface for grinding. Dressers may also provide grinding wheels with different profiles which may be desirable for performing different types of grinding operations.

In a grinding machine, a grinding wheel may be used as a tool in a computer numerical control (CNC) milling machine.

In factories and other manufacturing facilities, the rate at which articles can be manufactured is a key issue. In addition, the ability to reliably maintain that rate of output is also significant. To avoid down-time resulting from a grinding machine being taken offline for maintenance, a second grinding machine might be provided to act as a back-up to ensure the rate of output is not interrupted. Such machinery may be very large and very heavy and may incorporate large quantities of raw materials which may include non-renewable natural resources. In addition, the transport and installation of such machinery itself consumes energy. To reduce carbon emissions, and the unnecessary use of raw materials, some people have suggested that the only way forward is to accept reduced rate of output in manufacturing processes. Others have suggested that accepting lower reliability would also be an acceptable compromise. The inventors in the present case however have aimed to address at least some of these problems whilst reducing the environmental impact of high throughput manufacturing processes.

SUMMARY

Aspects of the invention are as set out in the independent claims and optional features are set out in the dependent claims. Aspects of the invention may be provided in conjunction with each other and features of one aspect may be applied to other aspects.

In an aspect there is provided a dresser apparatus for dressing a grinding wheel, the apparatus comprising: a dresser cradle unit for holding a dresser roll, and a rotary drive unit for driving the dresser roll wherein the dresser cradle unit is removable from the rotary drive unit. For example the dresser cradle unit may be of unitary construction, for example integrated into a dresser cradle housing, built to be lifted off, or otherwise removed from, the rotary drive unit as an integrated unit. For example it may be built to be lifted, slid, or lowered, away from the rotary drive unit. In an aspect there is provided a method of changing the dresser roll of a dresser apparatus for dressing a grinding wheel, the method comprising: disengaging a sealed drive linkage between a rotary drive of a dresser apparatus and a first dresser roll held in a dresser cradle unit, wherein the rotary drive is arranged to drive the dresser roll about a rotation axis and a seat is arranged to orient the dresser cradle unit in a selected position along the rotation axis; releasing the dresser cradle unit from the seat; removing the dresser cradle unit from the seat; seating a replacement dresser cradle unit in the seat, wherein the dresser cradle unit carries a second dresser roll; and, reengaging the sealed drive linkage.

In an aspect there is provided a removable dresser cradle unit for a grinding machine, the dresser cradle unit comprising: a dresser roll coupling for coupling a mandrel of the dresser cradle unit to a rotary drive; and a base having a locator configured to orient the dresser cradle unit in a seat for engagement of the dresser roll coupling with the rotary drive.

In an aspect there is provided a rotary drive unit for a dresser cradle unit of a grinding machine, the rotary drive unit comprising: a rotary drive housing for encapsulating a rotary drive separate from a removable dresser cradle unit; and wherein the rotary drive housing carries a drive coupling for coupling the rotary drive to the dresser cradle unit to drive a dresser roll of the removable dresser cradle unit.

Each of these foregoing aspects may be further refined as set out in the examples described herein. For example, the rotary drive unit and dresser cradle unit may comprise built-in sealing elements which interlock to form a seal when brought together. The apparatus may comprise a support for holding the dresser cradle unit in engagement with the rotary drive. For example the rotary drive unit may be fixed in a position on the support and a dresser cradle unit may be aligned with the rotary drive when positioned on the support. The support may comprise a seat for fixing a lateral location of the dresser cradle unit on the support. For example, coupling means, such as a pull-stud, may extend from the base of the dresser cradle unit to secure the dresser cradle unit to the seat on the support. The seat may comprise a chuck and the pull-stud may be configured to engage with an opening in the chuck to secure the position of the dresser cradle unit on the support. The base of the dresser cradle unit may comprise a recess, for example a circular groove, for a sealing ring of the seat to engage with.

The apparatus may comprise an air supply outlet, for example wherein the dresser cradle unit comprises an air intake and in which seating the dresser cradle unit on the support positions the air intake for connection with the air supply outlet. The outlet may comprise a nozzle for providing a jet of compressed air to the dresser cradle unit. The nozzle may be resilient.

The dresser cradle unit may comprise a dresser roll coupling for coupling the dresser roll coupling to the rotary drive. The dresser roll may be mounted on a mandrel which can be driven by the dresser roll coupling to cause the dresser roll to rotate. The dresser roll coupling may provide indirect or direct linkage to the mandrel. For example the dresser roll coupling may be provided by an end of the mandrel (e.g. a face), configured for coupling to a rotary drive.

The dresser cradle unit may comprise a dresser cradle housing for housing the dresser roll. For example the dresser cradle housing may house a dresser roll mounted on a mandrel, and may provide an opening to enable a grinding wheel to be brought into contact with a portion of the dresser roll. The dresser cradle housing may also comprise an opening for a face of the mandrel for example to enable coupling between the mandrel and the rotary drive. The dresser roll coupling and/or the drive coupling may be arranged to decouple from each other to allow the dresser cradle unit to be removed as a single unit.

The apparatus may comprise a rotary drive housing which encapsulates the rotary drive separate from the dresser cradle unit. The rotary drive housing may carry a drive coupling for coupling the rotary drive to the dresser roll coupling to drive the mandrel, which in turn drives the dresser roll. For example, the rotary drive may comprise a drive head and the drive coupling may be provided by a face of rotary drive. The drive head may be operable move axially along the axis of rotation of the rotary drive. This may enable the drive coupling to engage to the dresser roll coupling, which may provide a drive linkage.

The dresser cradle housing and the drive coupling may cooperate to provide the sealed drive linkage between the dresser cradle unit and the rotary drive. The sealed drive linkage may protect the dresser roll from the ingress of liquid. For example when a grinding wheel is being dressed by the dresser roll, a stream of liquid coolant may be provided around the contact point between the dresser roll and grinding wheel. The sealed drive linkage may prevent the ingress of liquid coolant to the drive linkage.

The sealing of the drive linkage may be provided by a labyrinth seal. For example the dresser cradle unit and rotary drive unit may comprise labyrinth elements, such as teeth and grooves, which may interlock when the dresser cradle unit and rotary drive unit are brought together to form the drive linkage. The labyrinth seal may be provided by the rotary drive housing and the dresser cradle housing. For example the dresser cradle housing may comprise a recess wherein the side edges comprise teeth and grooves to provide a 'female' labyrinth element. A portion of the rotary drive housing may protrude from the rest of the rotary drive housing, for example in the direction of the axis of rotation of the rotary drive to provide a 'male' labyrinth element. Two such elements may interlock to provide the labyrinth seal.

The drive coupling may comprise a V-ring seal for coupling to the drive coupling. For example the V-ring seal may couple to the dresser roll coupling when the sealed drive linkage is formed.

The labyrinth seal may comprise a drainage channel. For example the drainage channel may extend around the edge of the labyrinth seal. It may be provided by a gap between a tooth and a groove of two interlocking labyrinth elements. It may enable liquid between the two labyrinth elements to drain away.

The apparatus may comprise a disengager configured to disengage the sealed drive linkage thereby to enable the dresser cradle unit to be removed from the rotary drive unit. The disengager may be controllable to retract the drive coupling to disengage the sealed drive linkage. For example the disengager may comprise a pneumatically driven piston which may be operable retract the rotary drive and thereby to decouple the drive coupling from the dresser roll coupling.

The rotary drive may comprise a motor coupling for providing rotary force, about a rotation axis, to the drive coupling, and the drive coupling may be movable along the rotation axis relative to the motor coupling. For example the motor coupling may be provided by a pulley that couples to the rotary drive and is driven by a motor. For example the rotary drive may be pneumatically retracted and the drive coupling may be spring loaded such that the drive coupling may move axially along the axis of rotation of the rotary drive. For example the drive coupling may travel up to 7 mm along the axis of rotation.

The disengager may be controllable to retract the dresser roll coupling to disengage the drive linkage.

The air intake may be coupled to an airflow system arranged to pass a flow of air through the dresser cradle unit. For example the air intake may be provided by an opening in the base of the dresser cradle unit, through which the air supply outlet positioned on the support may be inserted.

The apparatus may comprise a manipulator arm operable to engage with the dresser cradle unit and remove the dresser cradle unit from the rotary drive unit. For example the manipulator arm may be configured to couple and decouple to a manipulator arm interface provided by the dresser cradle housing.

The apparatus may comprise an inter-lock configured to inhibit the manipulator arm from operating to move the dresser cradle unit unless the sealed drive linkage is disengaged.

The apparatus may comprise at least one replacement dresser cradle unit; for example wherein the at least one replacement dresser cradle unit holds a dresser roll. For example the at least one replacement dresser cradle unit may be stored in a dresser cradle storage unit. Dresser cradle units can be placed in and removed from the dresser cradle storage unit, for example by the manipulator arm.

The manipulator arm may be configured to replace the dresser cradle unit with the replacement dresser cradle unit. For example a computer may provide instructions to the manipulator arm to remove a dresser cradle unit from the dresser apparatus, place it in the dresser cradle storage unit, and disengage from the dresser cradle unit. The manipulator arm may also be provided with instructions to engage with a replacement dresser cradle unit in the dresser cradle storage unit and transport it to the dresser apparatus for positioning on the support. For example the instructions may be provided to the manipulator arm by an external computer.

The manipulator arm may be configured to disengage with the removed dresser cradle unit and engage with the replacement dresser cradle unit.

The dresser roll may be mounted on a mandrel. For example the mandrel may be inserted into a cylindrical hole that extends through the center of the dresser cradle housing to support the dresser roll.

The mandrel may be removable from the dresser cradle unit. For example the dresser cradle housing may comprise bearing caps configured to couple and decouple to the top surfaces of opposing walls of the dresser cradle housing. This may provide circular gaps within which two portions of the mandrel are enclosed, for example to secure the mandrel in place within the dresser cradle unit. The bearings caps may be decoupled from the dresser cradle housing wall to enable the mandrel to be lifted out of the dresser cradle unit.

Seating the replacement dresser cradle unit may position a drive coupling of the rotary drive for sealing engagement with the dresser cradle unit for forming the sealed drive linkage.

The dresser roll may be housed in a dresser cradle housing and the dresser cradle housing may cooperate with a drive coupling of the rotary drive to form the sealed drive linkage.

The dresser cradle unit may comprise a dresser roll coupling which cooperates with the drive coupling to form the drive linkage, and sealing the drive linkage may protect the dresser roll coupling from the ingress of liquid.

The sealed drive linkage is formed by a labyrinth seal.

The replacement dresser cradle unit may position an air intake of the dresser cradle unit for connection with an air supply outlet of the dresser apparatus.

The method may comprise retracting a drive coupling of the rotary drive to disengage the sealed drive linkage. Retracting the drive coupling may comprise moving the drive coupling along the rotation axis relative to a motor coupling of the rotary drive.

The method may comprise retracting the dresser roll coupling to disengage the sealed drive linkage. The dresser roll coupling may comprise a sealing adapter, configured to engage with a rotary drive to provide a sealed drive linkage.

The drive coupling may be configured to cooperate with the dresser cradle housing to provide a sealed drive linkage between the dresser cradle unit and the rotary drive.

The sealed drive linkage may be provided by a labyrinth seal.

The rotary drive unit may comprise a disengager configured to disengage the drive coupling from a dresser cradle unit, thereby to enable the dresser cradle unit to be removed from the rotary drive unit.

The disengager may be controllable to retract the drive coupling.

The rotary drive may comprise a motor coupling for providing rotary force, about a rotation axis, to the drive coupling, wherein the drive coupling may be movable along the rotation axis relative to the motor coupling.

BRIEF DESCRIPTION OF DRAWINGS

Embodiments of the disclosure will now be described, by way of example only, with reference to the accompanying drawings, in which.

SPECIFIC DESCRIPTION

Figure 1:
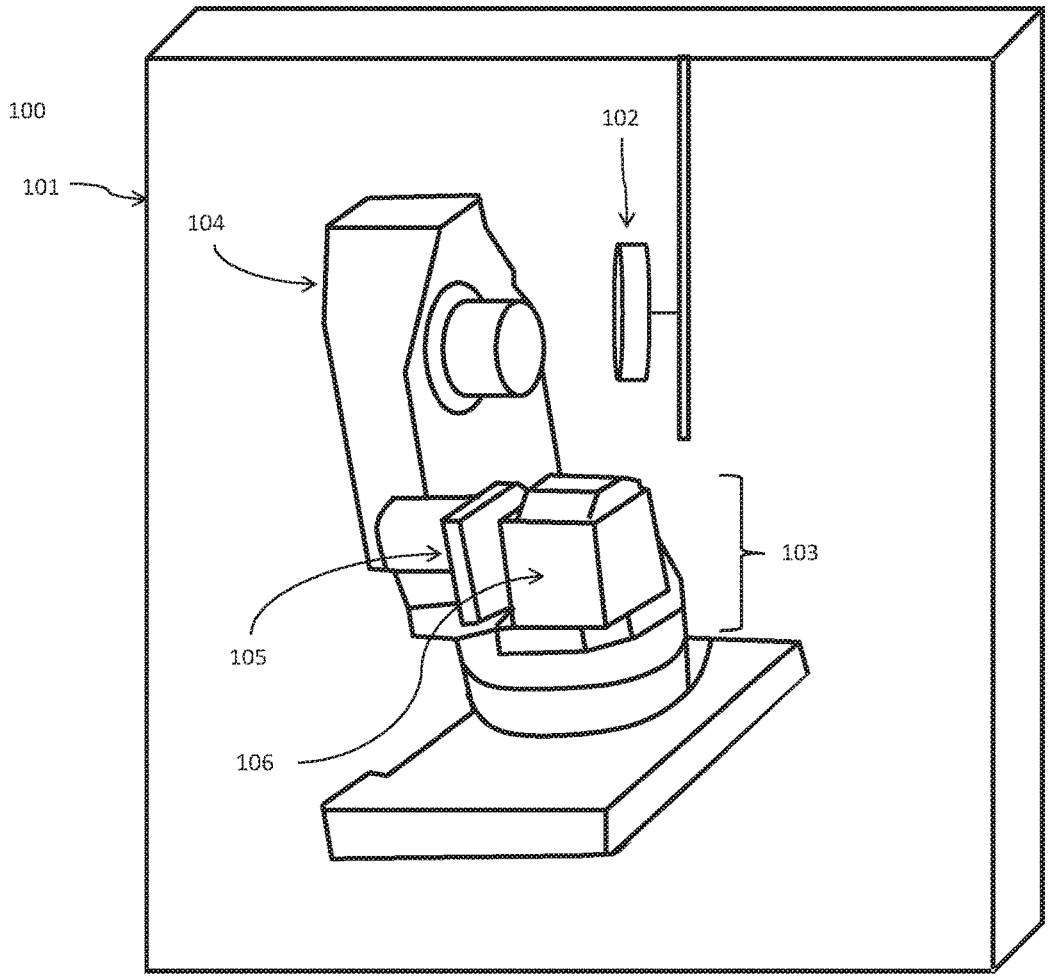
FIG. 1 illustrates a machine and a dresser apparatus.

A dresser apparatus for dressing a grinding wheel 102 is described with reference to FIG. 1. The dresser apparatus 103 comprises a dresser cradle unit 106 for holding a dresser roll (not shown), and a rotary drive unit 105 for driving the dresser roll. The dresser apparatus 103 is configured to enable the dresser cradle unit 106 to be removed from the rotary drive unit 105, and to be replaced with another dresser cradle unit 106 whilst leaving the rotary drive unit 105 intact. For example the dresser cradle unit 106 may be arranged to be removed from the rotary drive unit 105 as an integrated unit. This may enable one dresser cradle unit 106 to be easily and quickly replaced with another whilst reducing the delay or interruption associated with maintenance FIG. 1 shows a machine 100 comprising a grinding wheel 102, and a dresser apparatus 103 for dressing the grinding wheel 102. The machine comprises a machine housing 101, housing the grinding wheel and the dresser apparatus 103. The machine housing 101 also encloses a work unit 104 for holding a workpiece to be ground by the grinding wheel 102. The grinding wheel 102 and the work unit 104 are operable to move and rotate relative to one another—e.g. under CNC control. The grinding wheel 102 can thus be brought into contact with a work piece object secured to the work unit 104 in order to grind it into a desired shape. A grinding programme may be supplied to the machine 100 to control the grinding operation and the relative position of the grinding wheel 102 and object. The grinding wheel 102 is operable to translate and rotate along or about multiple axes within the machine 100.

A dresser apparatus 103 comprises the dresser cradle unit 106 mounted on a mandrel 302 for carrying a dresser roll and a the rotary drive unit 105 for driving the dresser roll. The grinding wheel 102 may be brought into contact with a dresser roll held on the mandrel 302 to dress or true the grinding wheel 102 e.g. to provide it with a desired profile. The dresser cradle unit is removable from the machine 100.

A manipulator arm (not shown) may also be provided which is operable to couple and decouple to the dresser cradle unit 106, for example to remove the dresser cradle unit from the work unit 104, or to replace the dresser cradle unit 106 with a replacement dresser cradle unit.

Figure 2:
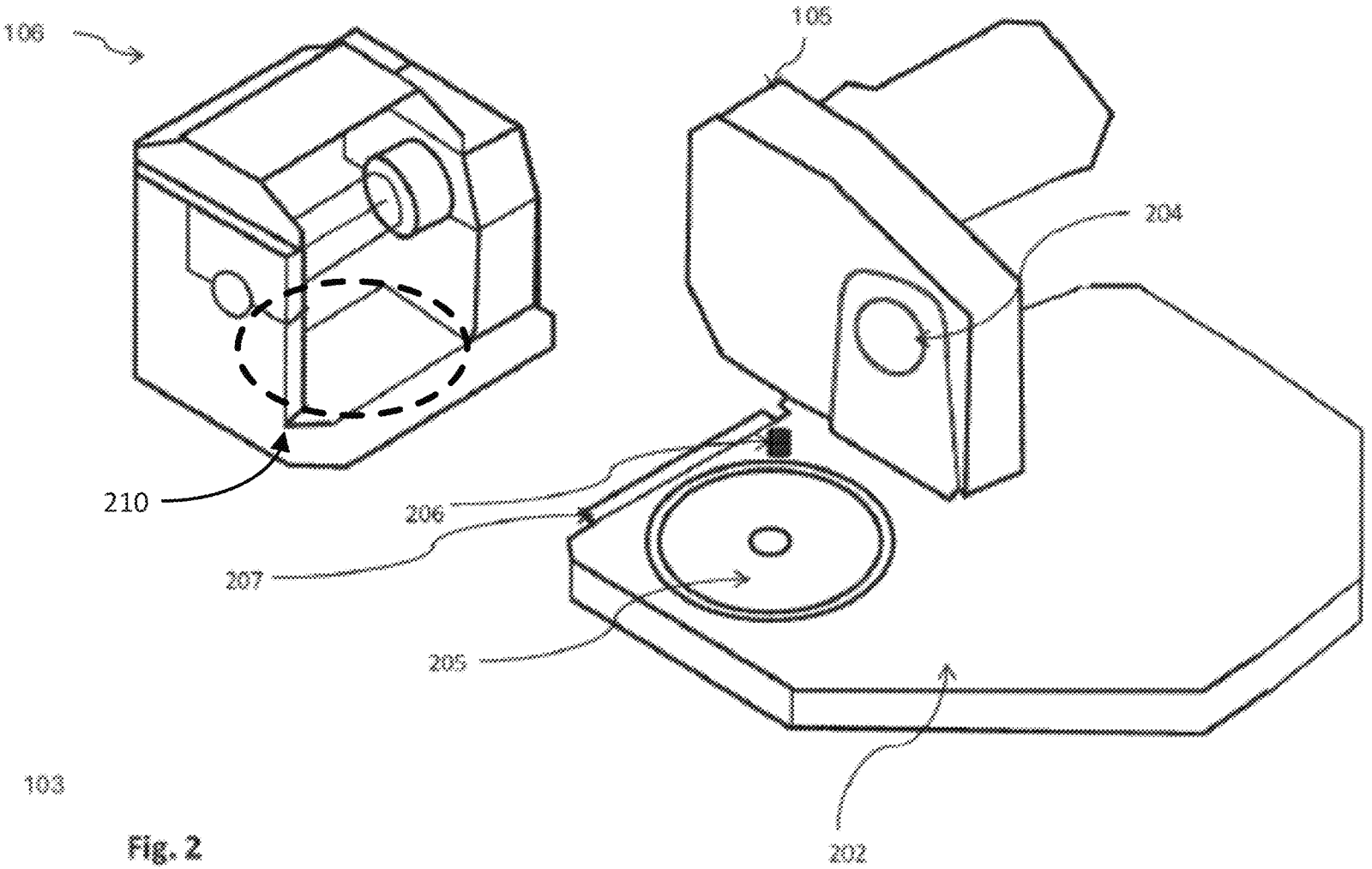
FIG. 2 illustrates a dressing apparatus for a grinding wheel.

FIG. 2 shows the dresser apparatus 103 for use in the machine 100 such as that illustrated in FIG. 1. The dresser apparatus 103 comprises the dresser cradle unit 106, the rotary drive unit 105 and a seat 205. The dresser apparatus 103 further comprises a support 202 for holding the dresser cradle unit 106 in engagement with the rotary drive unit 105. The rotary drive unit 105 is coupled to the support 202 such that the position of the rotary drive unit 105 is fixed relative to the support 202. The support comprises the seat 205 for fixing the lateral location of the dresser cradle unit 106. For example the seat 205 may comprise a chuck that acts as a zero point location system for fixing the lateral position of the dresser cradle unit 106 relative to the rotary drive unit 105. This may ensure that the dresser cradle unit 106 is positioned on the support 202 so that the mandrel 302 on which a dresser roll is mounted is aligned with the rotary drive 204. This may enable the rotary drive 204 to form a drive linkage and drive the dresser roll. For example a circular face of the rotary drive 204 may align with a face of the mandrel 302, upon which the dresser roll may be mounted, such that they share an axis of rotation.

The support 202 also comprises an air supply outlet 206 for supplying air to the dresser cradle unit 106. The air supply outlet 206 is mounted onto the support 202 in a fixed position relative to the seat 205 and the rotary drive unit 105. The outlet 206 may comprise a resilient nozzle for providing a jet of compressed air to the dresser cradle unit 106.

Figure 3A:
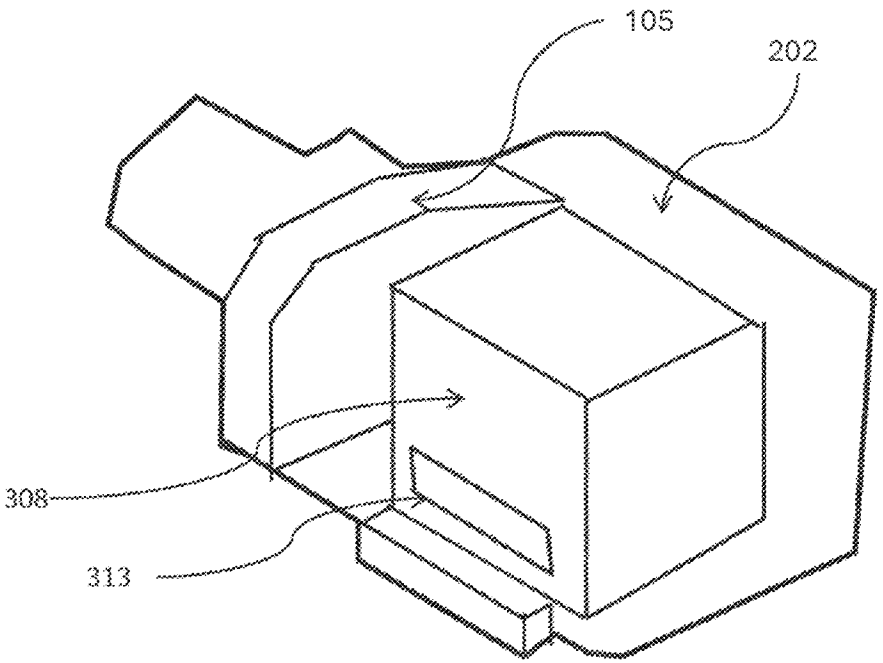
FIGS. 3A & 3B illustrate an isometric view of the front and back, respectively, of an example dresser cradle unit.
Figure 3B:
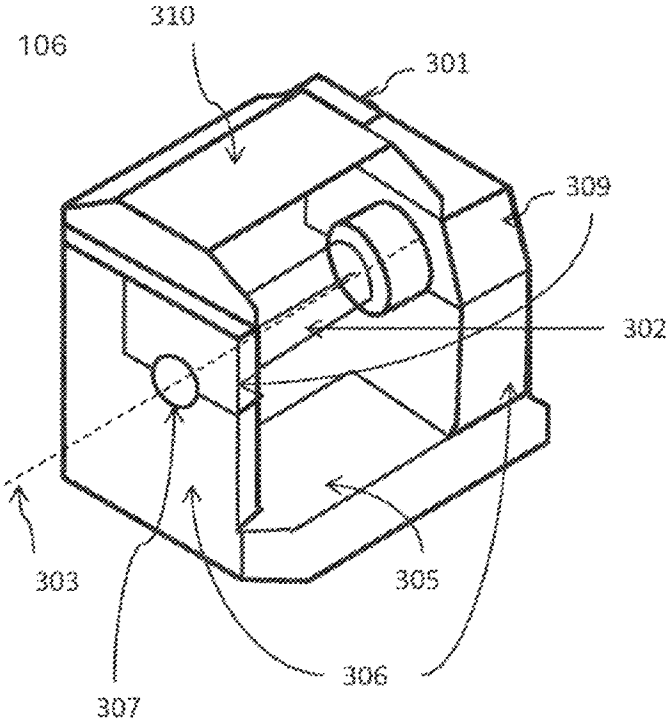

FIG. 3A and FIG. 3B show an example dresser cradle unit 106, for example one that may be used in the dresser apparatus 103 of FIGS. 1 and 2.

The dresser cradle unit 106 comprises a dresser cradle housing 301 which defines an interior space within which a dresser roll (not shown) can be housed. The mandrel 302 extends across a width of the interior space from one face of the dresser cradle housing 301 to an opposing face of the dresser cradle housing 301 to define an axis of rotation 303. A dresser roll may be mounted on the mandrel 302 and the mandrel 302 and dresser roll may be operable to rotate about the axis of rotation 303. The dresser cradle unit 106 comprises a dresser roll coupling 602 for coupling the mandrel 302 to the rotary drive 204, for example the rotary drive 204 of dresser apparatus 103.

The dresser cradle housing 301 comprises a base 305, and two parallel opposing walls 306 that extend perpendicular to the base 305. The top surfaces of the two parallel opposing walls 306 comprise semi-circular grooves 307 to enable the mandrel 302 to rest in the grooves. A back wall 308 extends perpendicularly between the ends of the two parallel opposing walls 306.

The dresser cradle housing 301 also comprises two bearing caps 309 coupled to the top surfaces of the two parallel opposing walls 306 to provide circular openings within which two portions of the mandrel 302 are enclosed, for example so that the mandrel 302 is held securely in place. This may minimize the translational movement of the mandrel 302 and any dresser roll mounted on it, during the dressing operation. The dresser cradle housing 301 also comprises a cover 310 coupled to the tops of the two parallel opposing walls 306 and the two bearing caps 309.

A dresser roll mounted on the mandrel 302 fits within the internal space of the dresser cradle housing 301, for example as defined by the two parallel opposing walls 306, the back wall 308, the base 305 and the cover 310 of the dresser cradle housing 301. The dresser cradle housing 301 has an opening between an edge of the cover 310 and a portion of the base 305 of the dresser cradle housing 301, to enable the dresser roll to be mounted on the mandrel 302 to make contact with the grinding wheel 102 during the wheel dressing operation. FIG. 3B shows the dresser cradle unit 106 positioned on the support 202 and aligned with the rotary drive unit 105. The dresser cradle unit 106 further comprises a manipulator arm interface 313 for a manipulator arm. In FIG. 3B the manipulator arm interface 313 protrudes from the back wall 308 of the dresser cradle housing 301. A manipulator arm may attach and lock on to the dresser cradle housing 301 at the manipulator arm interface 313. Once attached, the manipulator arm is operable to move the dresser cradle unit 106, for example to extract the dresser cradle unit 106 from the support 202 and rotary drive unit 105 of the dresser apparatus 103.

With reference again to FIGS. 2 and 3A, the under-surface of the base 305 of the dresser cradle unit 106 comprises a locator 210 configured to position the dresser cradle unit 106 in the seat 205 to enable the dresser roll coupling 602 to engage with the rotary drive 204. For example, coupling means, such as a pull-stud, extend from the base 305 of the dresser cradle unit 106 to secure the dresser cradle unit 106 to the seat 205 on the support 202. The seat 205 in FIG. 2 may comprise a chuck such as an Erowa PowerChuck®, and the pull-stud may be configured to engage with an opening in the chuck to secure the position of the dresser cradle unit 106 on the support 202. The base 305 of the dresser cradle unit 106 also comprises a recess, for example a circular groove, for a sealing ring of the seat to engage with. This may assist in securing the dresser cradle unit 106 on the seat 205 and minimize the ingress of liquid between the seat 205 and the dresser cradle unit 106.

The dresser cradle unit 106 also comprises an air intake (not shown), for example a cross drilling through the base (not shown) of the dresser cradle housing 301 that links to an air supply outlet, such as the air supply outlet 206 mounted on the support 202 in FIG. 2. Seating the dresser cradle unit 106 on the support 202, for example by mounting the dresser cradle unit 106 onto a chuck, positions the air intake of the dresser cradle unit 106 for connection with the air supply outlet 206 mounted on the support 202. The air intake may be coupled to an airflow system within the dresser cradle unit 106 that is arranged to pass a flow of air through the mandrel 302.

The support 202 comprises a set of compressed air control lines (not shown) that connect air outlets, such as the air supply outlet 206 for the dresser cradle unit 106, to fittings that extend out from the support 202 and connect to an external air supply. The fittings are protected by a steel cover 207 coupled to an edge of the support 202. The control lines may be integrated into the support 202, for example one line extends from the air supply outlet 206 through the interior of the support 202 to a fitting that connects to an external air supply.

The seat 205 may comprise an air-blast ring with openings spaced radially around the seat 205 for cleaning the locator, for example by providing a blast of air through the openings to the surface associated with the mounting features on the base 305 of the dresser cradle unit 106. The openings connect to an air supply via one of the compressed air control lines.

Figure 4:
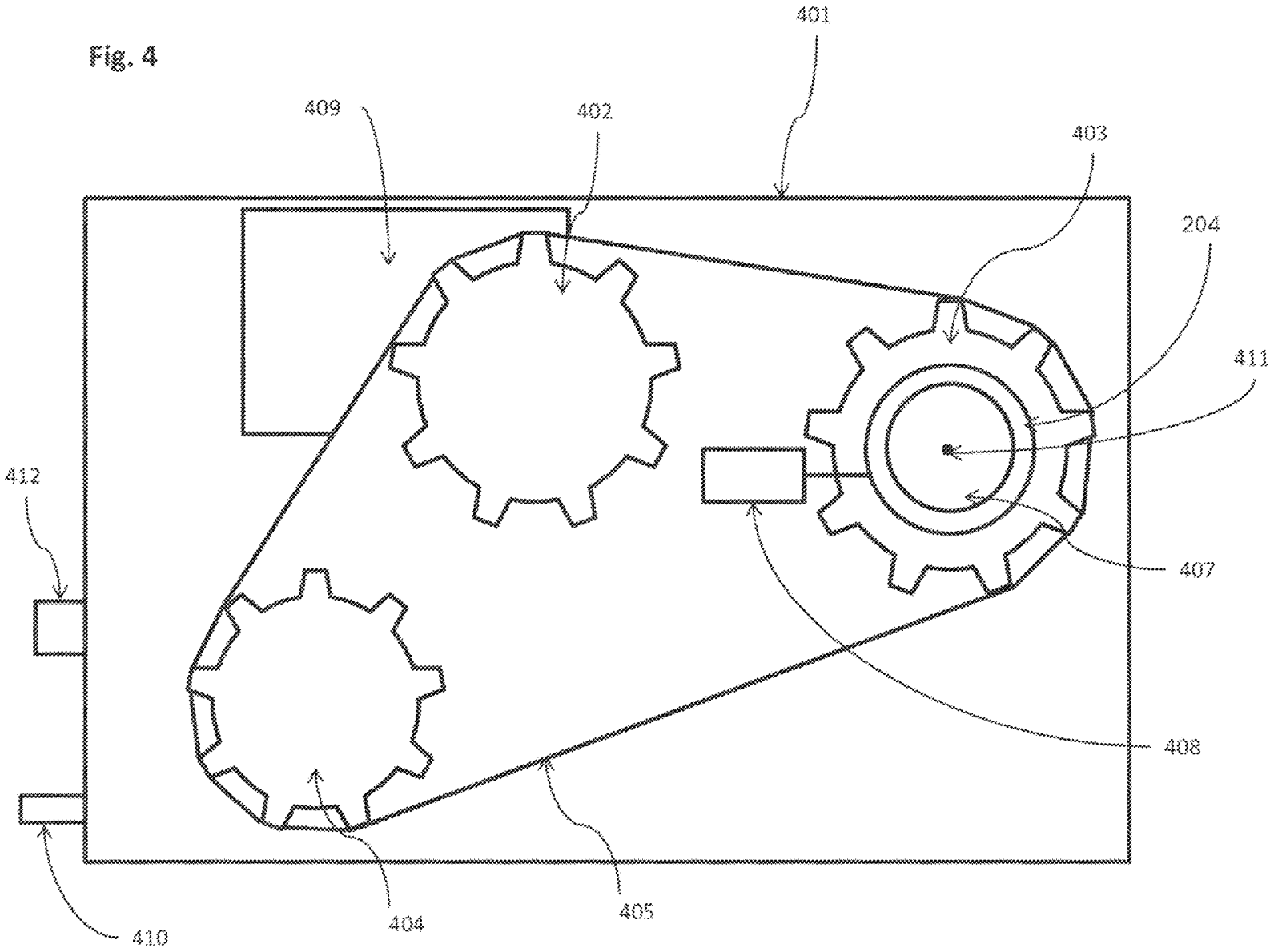
FIG. 4 illustrates an example rotary drive unit.

FIG. 4 shows an example of the interior of a rotary drive unit 105, for example one that could be used in the dresser apparatus 103 of FIG. 1. The cover plate (not shown) of the rotary drive unit 105 in FIG. 4 has been removed to show part of the drive mechanism. The cover plate is sealed to a face of the rest of the rotary drive housing 401 with an O-ring seal. The mechanism comprises a driver pulley 402, a driven pulley 403 and a tension pulley 404, which each comprise a toothed outer edge. These are coupled to one another via a toothed belt 405, such that the teeth of the belt interlock with the teeth on the outer edges of the three pulleys. The driver pulley 402, the driven pulley 403, and the tension pulley 404 are translationally fixed within the rotary drive housing 401 and are configured to rotate about an axis, wherein the rotation axes of the three pulleys are substantially parallel to one another. An electric motor 409 drives the rotation of the driver pulley 402. The rotation of the driver pulley 402 is configured to drive the toothed belt 405 and therefore drive the rotation of the driven pulley 403, and the tension pulley 404. The driven pulley 403 acts as a motor coupling for coupling to and driving the rotary drive 204. The tension pulley 404 may control the tension of the toothed belt 405 for example to ensure it remains in a taut state around the pulleys. The tension of the toothed belt 405 may be controlled by the operation of a belt tension adjuster 412 located on the exterior of the rotary drive housing 401, for example an adjustable screw coupled to the tension pulley 404. In other examples the rotary drive unit does not contain a tension pulley 404 and the toothed belt 405 couples only to a driver pulley 402 and a driven pulley 403.

A rotary drive 204 is mounted onto the motor coupling, for example the driven pulley 403, so that they share an axis of rotation 411. The rotary drive 406 may extend through an opening in the cover plate such that a drive coupling 407 (e.g. a circular outer face of the rotary drive 406) may be located outside of the rotary drive housing 401, enabling it to engage with and drive the rotation of other apparatus, such as the dresser apparatus 106.

The rotary drive 204 is operable to extend and retract along the axis of rotation 411 of the driven pulley 403, which acts as a motor coupling, such that for example the axial position of the drive coupling 407 relative to the driven pulley 403, which acts as a motor coupling, is adjustable.

For example the rotary drive 204 may be configured to travel axially between a retracted and extended position. A pneumatic cylinder is located along the axis of rotation 411 of the rotary drive 204, on the opposite side of the driven pulley 403, which acts as a motor coupling, which is operable to retract the rotary drive 204. The drive coupling 407 is the interface at which the rotary drive 204 may couple to the dresser roll coupling 602, for example to enable the rotary drive 204 to drive a dresser roll mounted on the mandrel 302 as shown in FIGS. 3A and 3B.

The drive mechanism also comprises switches 408 for monitoring the status of the rotary drive 204. For example, the switches 408 may monitor: the rotation of the rotary drive 204, the extent to which the drive coupling 407 is retracted, and whether the drive coupling 407 is in an engaged or disengaged state.

The rotary drive housing 401 comprises a compressed air connection point 410 that connects to one of the compressed air control lines in the support 202 to enable compressed air from an external supply to flow into the interior of the rotary drive housing 401 and increase the pneumatic pressure to allow the pneumatic cylinder to retract or extend the rotary drive 204, along the axis of rotation 411, and drive coupling 407 such that the drive coupling 407 interfaces with the dresser roll of the dresser cradle unit 106. For the rotary drive 204 to drive the dresser roll, a sealed drive linkage 620 is formed between the dresser cradle unit 106 and the rotary drive 204. For example, the dresser cradle housing 301 of the dresser cradle unit 106 and the drive coupling 407 carried by the rotary drive housing 401 may cooperate to provide the sealed drive linkage 620 between the dresser cradle unit 106 and the rotary drive 204.

The sealed drive linkage 620 between the rotary drive 204 and the dresser roll may be formed by an engagement/disengagement mechanism, such that when the dresser cradle unit 106 is positioned in the seat 205, the mechanism brings the drive coupling 407 into contact with the dresser roll coupling 602. As discussed in relation to FIG. 4, the drive coupling 407 may travel axially relative to the driven pulley 403, and the extent to which the drive coupling 407 extends out from the rotary drive housing 401 may be adjusted for it to couple to the dresser roll coupling 602.

Figure 5:
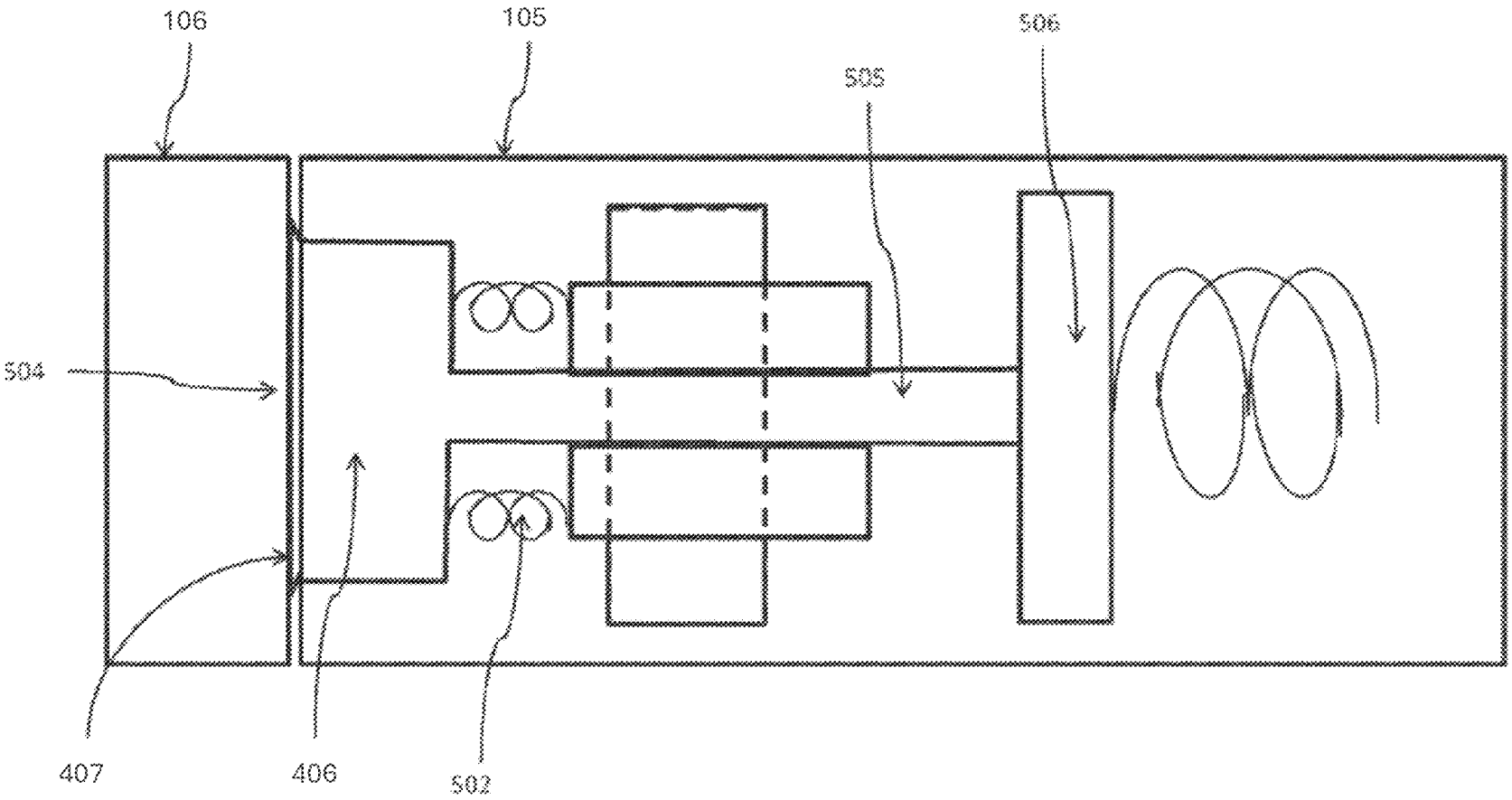
FIG. 5 shows an example coupling arrangement between a rotary drive unit and a dresser cradle unit.

FIG. 5 shows a schematic view of an example drive linkage between the dresser cradle unit 106 and the rotary drive unit 105. The rotary drive 204 may be moveable, for example it may comprise control springs 502 such that the drive coupling 407 is spring loaded in order to extend and engage with the dresser roll coupling 602. The mechanism may comprise a disengager configured to disengage the sealed drive linkage 620 and thereby enable the dresser cradle unit 106 to be removed from the rotary drive unit105. For example the rotary drive 204 comprises a splined shaft 505 that may be controlled by a pneumatically driven piston 506, such that the drive coupling 407 is retracted to disengage the sealed drive linkage 620. In another example the disengager is controllable to retract the dresser roll coupling 602 to disengage the sealed drive linkage 620. It will be appreciated that the engagement region 504 may enable a dresser roll coupling 602 to be brought into engagement with the rotary drive 204.

The drive linkage may be sealed to protect the coupling arrangement from the ingress of liquid. The sealing may be provided by a labyrinth seal between the dresser cradle housing 301 and the rotary drive housing 401. The labyrinth seal is comprised of several tooth-like elements on one component that interlock with grooves in another component. For example the rotary drive housing 401 may carry a 'male' labyrinth element 611 that extends outwards from the rotary drive housing 401, and the dresser cradle housing 301 may comprise a recess which provides a 'female' labyrinth element 603. When the rotary drive 204 is brought into engagement with the dresser cradle unit 106, these two elements may be brought together to interlock and form the labyrinth seal.

Figure 6A:
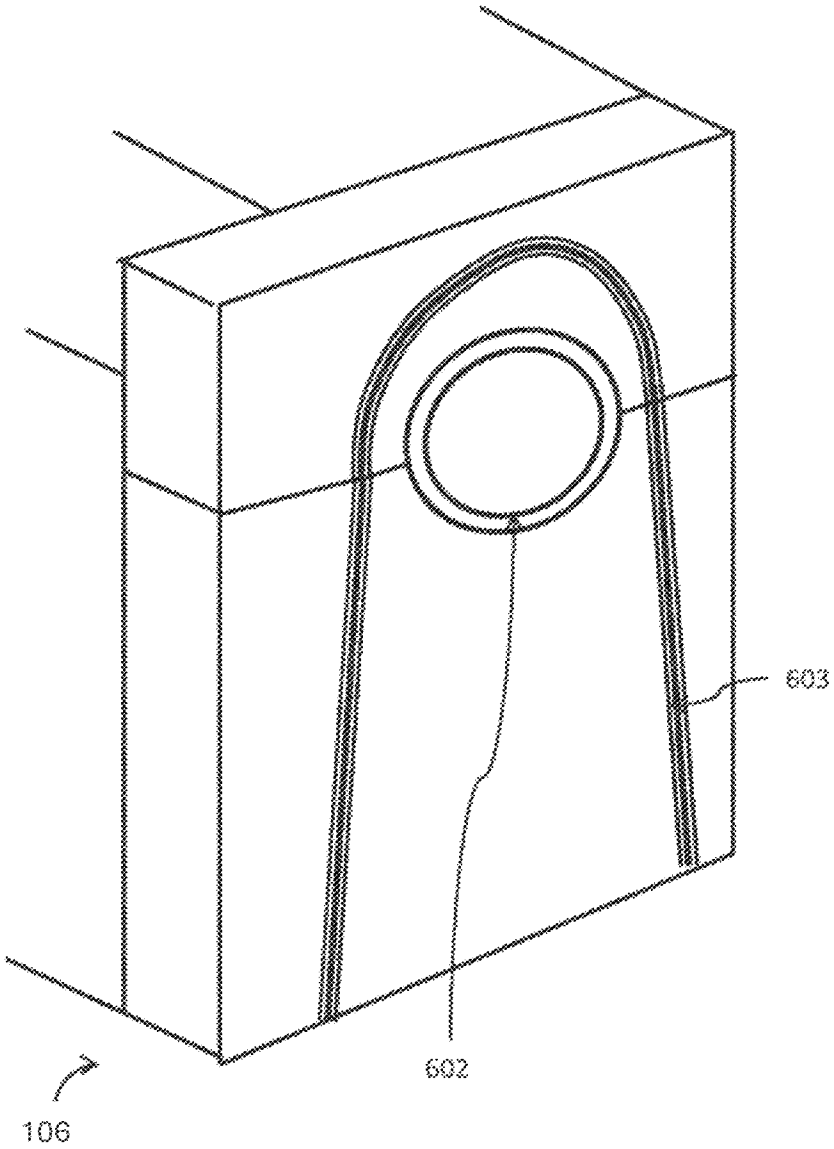
FIGS. 6A-C illustrate a sealing arrangement between a rotary drive unit and a dresser cradle unit.

FIG. 6A shows an example of a portion of the dresser cradle unit 106 for coupling to the rotary drive unit 105. An end face of the mandrel 302 is exposed through the hole created by the two bearing caps 309 and semi-circular grooves 307 in a face of the dresser cradle housing 301 to provide the dresser roll coupling 602 which cooperates with the drive coupling 407, for example an end face of the rotary drive 204, to form the sealed drive linkage 620. The face of the dresser cradle housing 301 comprises a recess for forming a seal with the rotary drive housing 401. The recess provides the female labyrinth element 603 comprising a set of teeth and grooves around the edge of the recess, between which the teeth and grooves of the male labyrinth element 611 can interlock to form a seal.

Figure 6B:
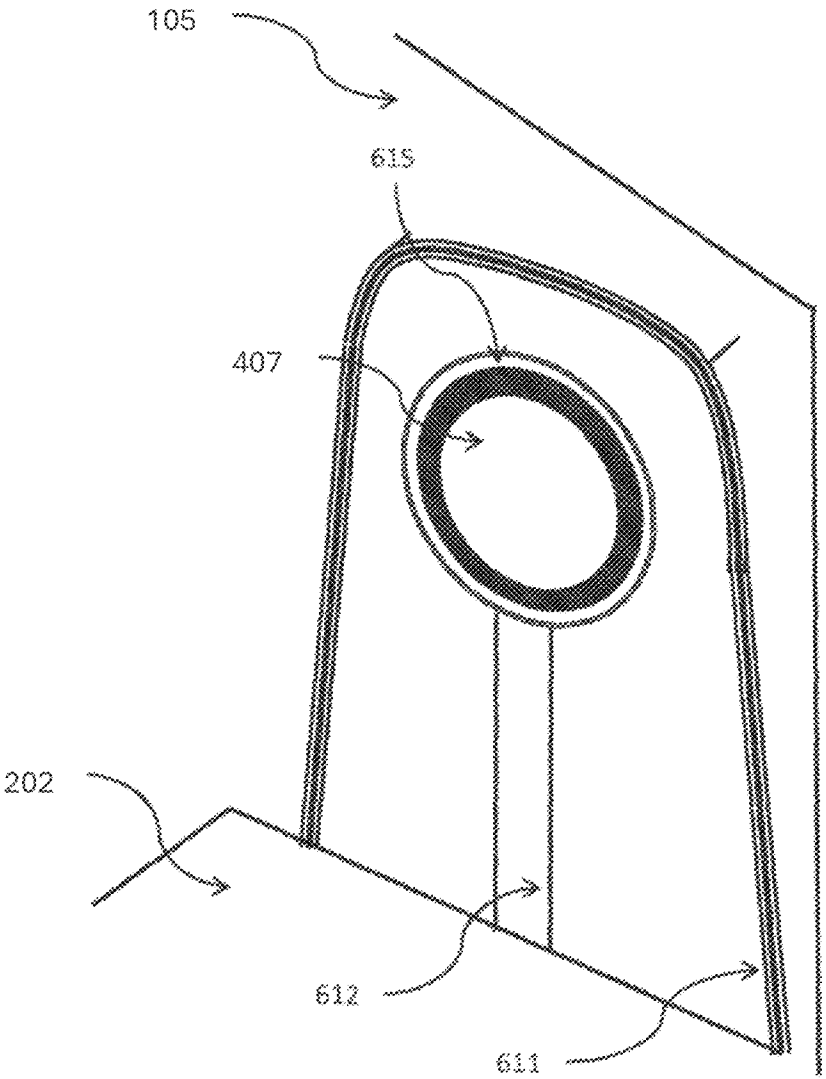

FIG. 6B shows an example of a portion of the rotary drive unit 105 for coupling to a dresser cradle unit 106. The rotary drive housing 401 provides the male labyrinth element 611 which extends from the cover plate of the rotary drive housing 401 along the axis of rotation of the rotary drive 204. The male labyrinth element 611 comprises a set of teeth for interlocking with the grooves the female labyrinth element 603. When the dresser cradle unit 106 and rotary drive unit 105 are brought together, for example by positioning the dresser cradle unit 106 on the seat 205 as described above, the interlocking labyrinth elements form a labyrinth seal for protecting the sealed drive linkage 620 from the ingress of liquid. For example, during the grinding operation of the machine 100 in which the dresser apparatus 103 is situated, liquid coolant may be injected into an area around the grinding wheel 102. The seal provided may prevent liquid from seeping into the sealed drive linkage 620 and disrupting the operation of the dresser apparatus 103. When the sealed drive linkage 620 is formed there is a gap between the male labyrinth element 611 and female labyrinth element 603; the interlocked teeth and grooves of the two labyrinth elements do not contact one another. The rotary drive housing 401 further comprises a drain channel 612 to enable liquid between the rotary drive unit 105 and the dresser cradle unit 106 to drain away from the sealed drive linkage 620. For example the drain channel 612 is provided by a groove in the male labyrinth element 611 that extends from the opening for the drive coupling 407 in the rotary drive housing 401 to the base of the rotary drive unit 105 where it meets the support 202.

Figure 6C:
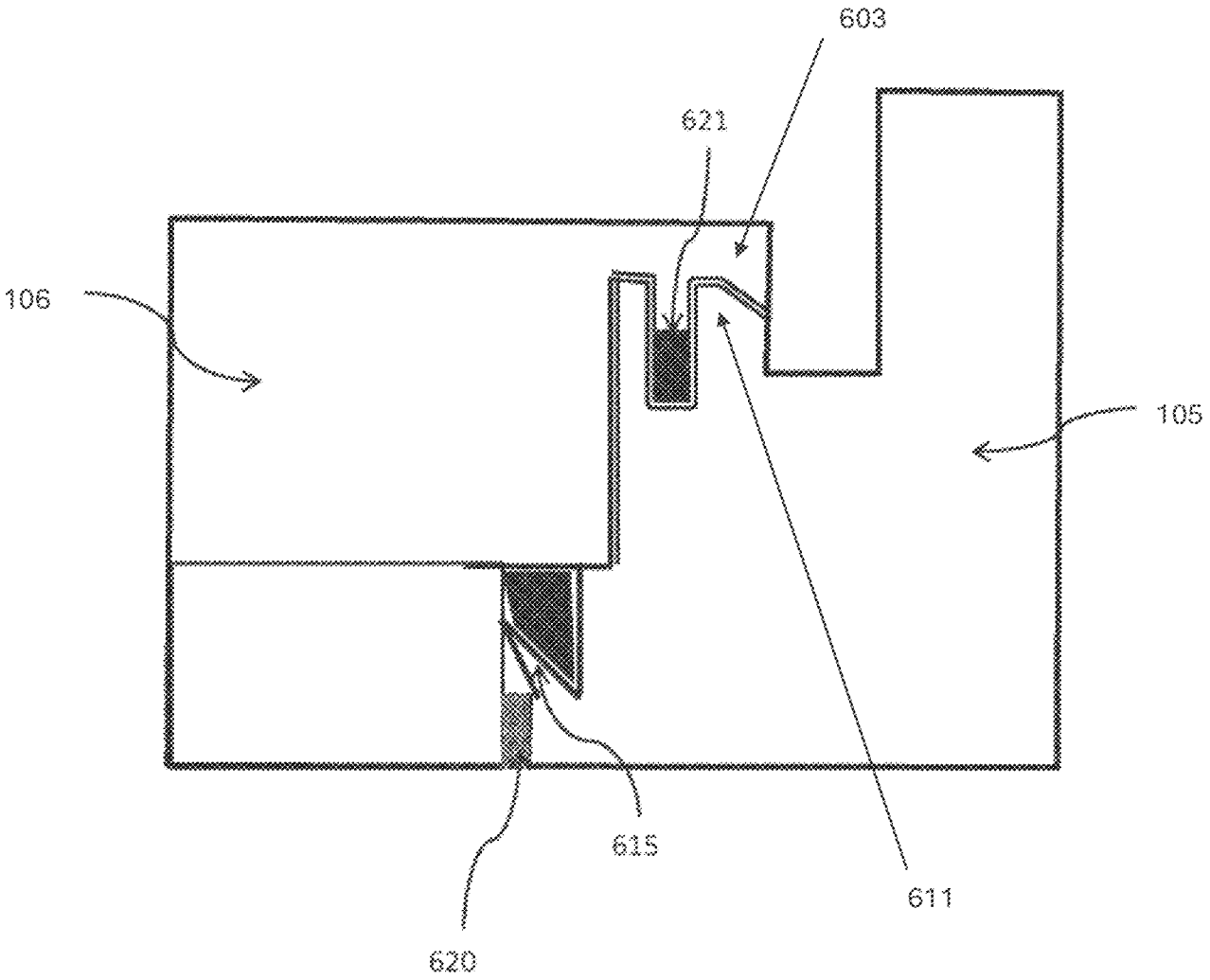

FIG. 6C shows an example of a sealed drive linkage 620 formed between the dresser cradle unit 106 and the rotary drive 204. Teeth and grooves from the male labyrinth element 611 of the rotary drive unit 105 and female labyrinth element 603 of the dresser cradle unit 106 are shown interlocking with one another to form a labyrinth seal around the drive linkage, to create the sealed drive linkage 620. The formation of the labyrinth seal may provide a labyrinth drainage channel 621. For example forming the labyrinth seal may provide a passage between the male labyrinth element 611 and the female labyrinth element 603 along the length of the labyrinth seal. FIG. 6C shows a gap between a tooth of the female labyrinth element 603 and a groove in the male labyrinth element 611 for example that provides the labyrinth drainage channel 621. This may enable liquid between the two labyrinth elements to drain away when the sealed drive linkage 620 is formed.

As shown in FIGS. 6B and 6C, the drive coupling 407 further comprises a V-ring seal 615 for sealing the sealed drive linkage 620 between the dresser roll coupling 602 and the drive coupling 407, for example to protect the sealed drive linkage 620 from the ingress of liquid from the grinding wheel 102. The V-ring seal 615 comprises a ring, of elastomer for example, mounted to the drive coupling 407. The V-ring seal 615 comprises a tapered lip that extends from the drive coupling 407 at an oblique angle for sealing against the surface of the dresser roll coupling 602. During the dressing operation the V-ring seal 615 rotates as the rotary drive 204 rotates, maintaining a seal between the dresser roll coupling 602 and the drive coupling 407.

A manipulator arm may be provided configured to load and unload the dresser cradle unit 106 from the seat 205 on the support 202. An example method of loading and unloading a dresser cradle unit 106 using a manipulator arm is described herein. A computer programme may provide the manipulator arm with instructions to perform the actions described herein. In order to load a dresser cradle unit 106, the manipulator arm engages with the manipulator arm interface 313 on the dresser cradle unit 106 and moves the dresser cradle unit 106 to approach the support 202 in a 'pre-load' position in proximity to the support 202. The manipulator arm then laterally aligns the dresser cradle unit 106 with the rotary drive housing 401, by aligning the labyrinth seal arrangement on the dresser cradle unit 106 with the labyrinth seal arrangement on the rotary drive housing 401. Once aligned the manipulator arm lowers the dresser cradle unit 106 onto the seat 205 until the pull-stud on the under-surface of the base 305 of the dresser cradle unit 106 engages with the chuck. When the dresser cradle unit 106 is secured in position, the manipulator arm disengages from the manipulator arm interface 313. In order to unload the dresser cradle unit 106, the steps above may be performed in reverse. The manipulator arm may be configured, however, to only remove the dresser cradle unit 106 from the seat 205 if the drive linkage is disengaged. For example an interlock may inhibit the manipulator arm and prevent it from removing the dresser cradle unit 106 when the sealed drive linkage 620 is engaged.

The apparatus may further comprise at least one replacement dresser cradle unit (not shown). These may be stored in a dresser cradle storage unit (not shown). The replacement dresser cradle units hold a dresser roll, so that a dresser roll can be replaced by replacing the dresser cradle unit.

A manipulator arm may also be operable to replace the dresser cradle unit 106 with a replacement dresser cradle unit. For example, the manipulator arm may configured to engage with the dresser cradle unit 106, such as the dresser cradle unit 106 positioned on the seat 205 for engagement with a rotary drive 204, at its manipulator arm interface 313. If the sealed drive linkage 620 is disengaged the manipulator arm may remove the dresser cradle unit 106 from the seat 205 and transport it away from the support 202, for example to the dresser cradle storage unit 106. The manipulator arm disengages with the removed dresser cradle unit and engages with the manipulator arm interface 313 of the replacement dresser cradle unit. It may then transport the replacement dresser cradle unit to the support 202, position it on the seat 205 and disengage from the manipulator arm interface 313.

In an embodiment the dresser cradle unit 106 is configured to be loaded and unloaded onto the seat 205, and when in position to form the sealed drive linkage 620 between the rotary drive 204 and a dresser cradle unit 106carried by the dresser cradle unit 106. To load a dresser cradle unit 106 into the dresser apparatus 103 the dresser cradle unit 106 is brought in line with a rotary drive unit 105. The dresser roll coupling 602, which drives the mandrel 302 carrying the dresser roll, is aligned with the rotary drive 204. The dresser cradle unit 106 is lowered onto the seat 205, such as a chuck, that a pull-stud on the base 305 of the dresser cradle unit 106 engages with to secure the dresser cradle unit 106 onto the support 202. The dresser cradle unit 106 and rotary drive unit 105 both have sealing elements such that as the dresser cradle unit 106 is positioned on the chuck a seal is formed around the rotary drive 204 and mandrel 302. The rotary drive 204 may extend from the rotary drive unit 105 to couple to the mandrel 302 and form the sealed drive linkage 620 for driving the rotation of the dresser roll. The aforementioned steps may be performed in reverse order to disengage the sealed drive linkage 620 between the rotary drive 204 and the dresser cradle unit 106, and remove the dresser cradle unit 106 from the dresser apparatus 103. In this way one dresser cradle unit 106 may be replaced with another.

The above embodiments are to be understood as illustrative examples. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

Other variations and modifications of the apparatus will be apparent to persons of skill in the art in the context of the present disclosure.

In an aspect there is provided a dresser cradle unit 106 for a grinding machine 100, the dresser cradle unit comprising: a dresser roll coupling 602 for coupling a mandrel 302 of the dresser cradle to a rotary drive; and a base having a locator configured to position the dresser cradle unit 106 in a seat 205 for engagement of the dresser roll coupling 602 with the rotary drive 204.

In an aspect there is provided a rotary drive unit 105 for a dresser cradle unit 106 of a grinding machine 100, the rotary drive unit 105 comprising: a rotary drive housing 401 for encapsulating a rotary drive 204 separate from a dresser cradle unit 106; and wherein the rotary drive housing 401 carries a drive coupling 407 for coupling the rotary drive 204 to the dresser cradle unit 106 to drive a dresser roll.

The invention claimed is:

1. A dresser apparatus for dressing a grinding wheel, the apparatus comprising:

a dresser cradle unit for holding a dresser roll mounted on a mandrel, wherein the dresser cradle unit comprises an air intake, and a dresser housing defining an interior space for housing the dresser roll mounted on the mandrel, the dresser housing comprising a first wall and a second wall opposing the first wall and spaced from the first wall to define a width for the mandrel to extend across, wherein the dresser housing comprises an opening to enable the grinding wheel to be brought into contact with a portion of the dresser roll, and a rotary drive for driving the dresser roll;

a support for holding the dresser cradle unit in engagement with the rotary drive;

and an air supply outlet;

wherein the dresser cradle unit is removable as a unit from the rotary drive; and wherein seating the dresser cradle unit on the support positions the air intake for connection with the air supply outlet.

2. The apparatus of claim 1 comprising a sealed drive linkage between the dresser cradle unit and the rotary drive.

3. The apparatus of claim 2 wherein the dresser cradle unit and the rotary drive unit each comprise a sealing element which, when brought together, provide the sealed drive linkage.

4. The apparatus of claim 1 wherein the support comprises a seat for fixing a lateral location of the dresser cradle unit on the support.

5. The apparatus of claim 1 wherein the dresser cradle unit comprises a dresser roll coupling for coupling the dresser roll to the rotary drive.

6. The apparatus of claim 1 wherein the dresser housing and a drive coupling cooperate to provide a sealed drive linkage between the dresser cradle unit and the rotary drive.

7. The apparatus of claim 6 wherein the sealed drive linkage protects the drive coupling and/or the dresser housing from ingress of liquid.

8. The apparatus of claim 7 wherein the sealing of the sealed drive linkage is provided by a labyrinth seal.

9. The apparatus of claim 6 comprising a disengager configured to disengage the sealed drive linkage thereby to enable the dresser cradle unit to be removed from the rotary drive unit.

10. The apparatus of claim 9 wherein the disengager is controllable to retract the drive coupling to disengage the sealed drive linkage.

11. The dresser apparatus of claim 4, wherein the dresser cradle unit comprises a base having a locator configured to orient the dresser cradle unit in the seat for engagement of the dresser cradle unit with the rotary drive unit.

12. The dresser apparatus of claim 1, wherein the rotary drive unit comprises: a rotary drive housing for encapsulating the rotary drive unit separate from the removable dresser cradle unit; and wherein the rotary drive housing carries a drive coupling for coupling the rotary drive to the dresser cradle unit to drive a dresser roll of said removable dresser roll cradle unit.

13. The dresser apparatus of claim 12 wherein the drive coupling is configured to cooperate with a dresser cradle housing of the dresser cradle unit to provide a sealed drive linkage between the dresser cradle unit and the rotary drive.

14. The dresser apparatus of claim 12 in which the rotary drive comprises a motor coupling for providing rotary force, about a rotation axis, to the drive coupling, and wherein the drive coupling is movable along the rotation axis relative to the motor coupling.

* * * * *